US006415845B2

(12) United States Patent
Cattaneo

(10) Patent No.: US 6,415,845 B2
(45) Date of Patent: Jul. 9, 2002

(54) CONNECTOR INCLUDING A TAB AND AN ELASTIC LOCK FOR SECURING A SLIDEWAY TO AN END SUPPORT OF A ROLLER MECHANISM FOR A CLOSURE

(75) Inventor: Rino Cattaneo, Vedano al Lambro (IT)

(73) Assignee: Simbac S.p.A., Mezzago (IT)

( * ) Notice: Subject to any disclaimer, the term of this patent is extended or adjusted under 35 U.S.C. 154(b) by 0 days.

(21) Appl. No.: 09/760,672

(22) Filed: Jan. 17, 2001

(30) Foreign Application Priority Data

Jan. 31, 2000 (FR) ..... 00 01219

(51) Int. Cl.[7] ..... E06B 9/00
(52) U.S. Cl. ..... 160/323.1; 160/903
(58) Field of Search ..... 160/323.1, 903, 160/19, 23.1, 26, 38

(56) References Cited

U.S. PATENT DOCUMENTS 4,234,032 A * 11/1980 Stark ..... 160/133 X
5,067,540 A * 11/1991 Besler ..... 160/23.1 X
5,609,196 A * 3/1997 Kraler ..... 160/23.1 X
5,655,586 A * 8/1997 Cattaneo ..... 160/903 X
5,655,587 A * 8/1997 Kraler ..... 160/903 X

FOREIGN PATENT DOCUMENTS

EP 0671537 9/1995

* cited by examiner

*Primary Examiner*—David M. Purol
(74) *Attorney, Agent, or Firm*—Dowell & Dowell, P.C.

(57) ABSTRACT

A connector for securing a side support for a roller shaft to a slideway for guiding closure selectively wound about the roller shaft wherein the connector includes a tab having a lower portion engaging the slideway and an upper portion engageable with the side support for the roller shaft. The connector further includes an elastic lock member insertable within an opening in the tab for securing the tab to the side support for the closure member by way of at least two resilient hooks associated with the elastic lock member which are engageable with the tab and the side support for the roller shaft.

10 Claims, 5 Drawing Sheets

CONNECTOR INCLUDING A TAB AND AN ELASTIC LOCK FOR SECURING A SLIDEWAY TO AN END SUPPORT OF A ROLLER MECHANISM FOR A CLOSURE

FIELD OF THE INVENTION

The present invention relates to a device for connection between a roller shaft support and slideways for laterally holding a shade body in a closure or sun protection installation. The invention also relates to a mechanism for manoeuvring a closure or sun protection installation comprising such a connection device.

Closure installation is understood to mean doors, gates, blinds and equivalent equipment.

BRIEF DESCRIPTION OF THE RELATED ART

EP-A-0 671 537 discloses a universal support for laterally guiding a roller blind, this support comprising interchangeable lateral rods or tabs intended to be inserted in a slideway for guiding a roller blind, being fixed in the lower part of a lateral face of a box. These interchangeable rods or tabs make it possible efficiently to position the slideways with respect to the box of the blind. However, it has appeared from experience that, when an installation comprising such a box and such slideways is positioned, it may happen that the aforementioned rods or tabs become detached from the bracket and drop to the floor, which means that the installer must stop positioning them in order to pick up the dropped element and replace it, such manipulations most often obliging the installer to get down from a ladder.

It is a more particular object of the present invention to overcome the problems set forth hereinabove by proposing a connection device which virtually eliminates the risks of a connecting tab being unhooked with respect to its environment when the closure installation is being positioned and used.

SUMMARY OF THE INVENTION

To that end, the invention relates to a device for connection between a roller shaft support and at least one slideway for laterally maintaining a shade body of a closure or sun protection installation, which comprises at least one connection tab adapted to engage, on the one hand, with the slideway and, on the other hand, with the support. This device is characterized in that it comprises an elastic member for locking the tab with the support by cooperation of shapes, this member comprising at least an elastically deformable first tongue equipped with a first beak adapted to clip against a surface of the tab and at least an elastically deformable second tongue equipped with a second beak adapted to clip against a surface of the support, this elastic member being adapted to form a stop against a displacement of the tab with respect to the support in the sense of separation of the tab with respect to the support.

The elastic locking member or clip of the invention avoids an untimely disconnection of the connecting tab with respect to the support and therefore limits the risks of this tab, which is at least partially engaged inside the slideway in question, dropping.

According to advantageous but non-compulsory aspects of the invention, the device incorporates one or more of the following characteristics:

The elastic locking member comprises two substantially parallel first tongues each equipped with a beak adapted to clip against a surface of the tab, these beaks being oriented towards the outside of the tongues with respect to an intermediate space defined therebetween. The elastic clipping of the locking member on the tab may thus occur by an expansion of the tongues which may be compressed due to the geometry of the surfaces of the tab with which they cooperate. The second tongue may be provided to extend, from a zone forming a base common to the first tongues and to the second tongue, at least partially in a direction substantially parallel to the first tongues and outside the intermediate space mentioned above.

Each beak is bordered by a retaining surface substantially perpendicular with respect to a principal direction of the tongue in question and by a surface forming a ramp, inclined with respect to this principal direction. The inclined surface of each beak makes it possible to generate a progressive deformation of the tongue which bears it, during positioning of the elastic locking member.

The tab forms a housing for receiving the locking member, this housing defining at least one surface for cooperation with the beak of the first tongue. The support is advantageously provided with a heel projecting, from an end surface of the support and when the tab is in engagement on the support, towards the interior of the said housing, while this heel defines a surface adapted to cooperate with the beak of the second tongue. The housing may be provided with an opening for access to at least one of the beaks, this opening allowing the insertion of a means for disengaging this beak with respect to a corresponding surface of the support or of the tab. Thanks to this opening, it is possible to release the locking member with respect to the support or to the tab, which allows the installation to be dismantled.

The housing forms a stop adapted to abut against the locking member in place in the housing during a relative movement of the tab and of the support in a sense of separation of the tab and of the support.

The tab is adapted to be brought into engagement with the support by a translation in a direction and a sense defined by the cooperating parts of this support and this tab, this locking member being adapted to oppose, after engagement of the tab on the support, a translation of the tab with respect to the support in the same direction and in opposite sense.

The invention also relates to a mechanism for maneuvering a closure or sun protection installation which comprises a connection device as described hereinabove. Such a mechanism is simpler to install and to adjust than the mechanisms of the prior art.

BRIEF DESCRIPTION OF THE DRAWINGS

The invention will be more readily understood and other advantages hereof will appear more clearly on reading the following description of an embodiment of a mechanism for manoeuvring a closure installation in accordance with its principle, given solely by way of example and made with reference to the accompanying drawings, in which.

DESCRIPTION OF PREFERRED EMBODIMENT

Figure 1:
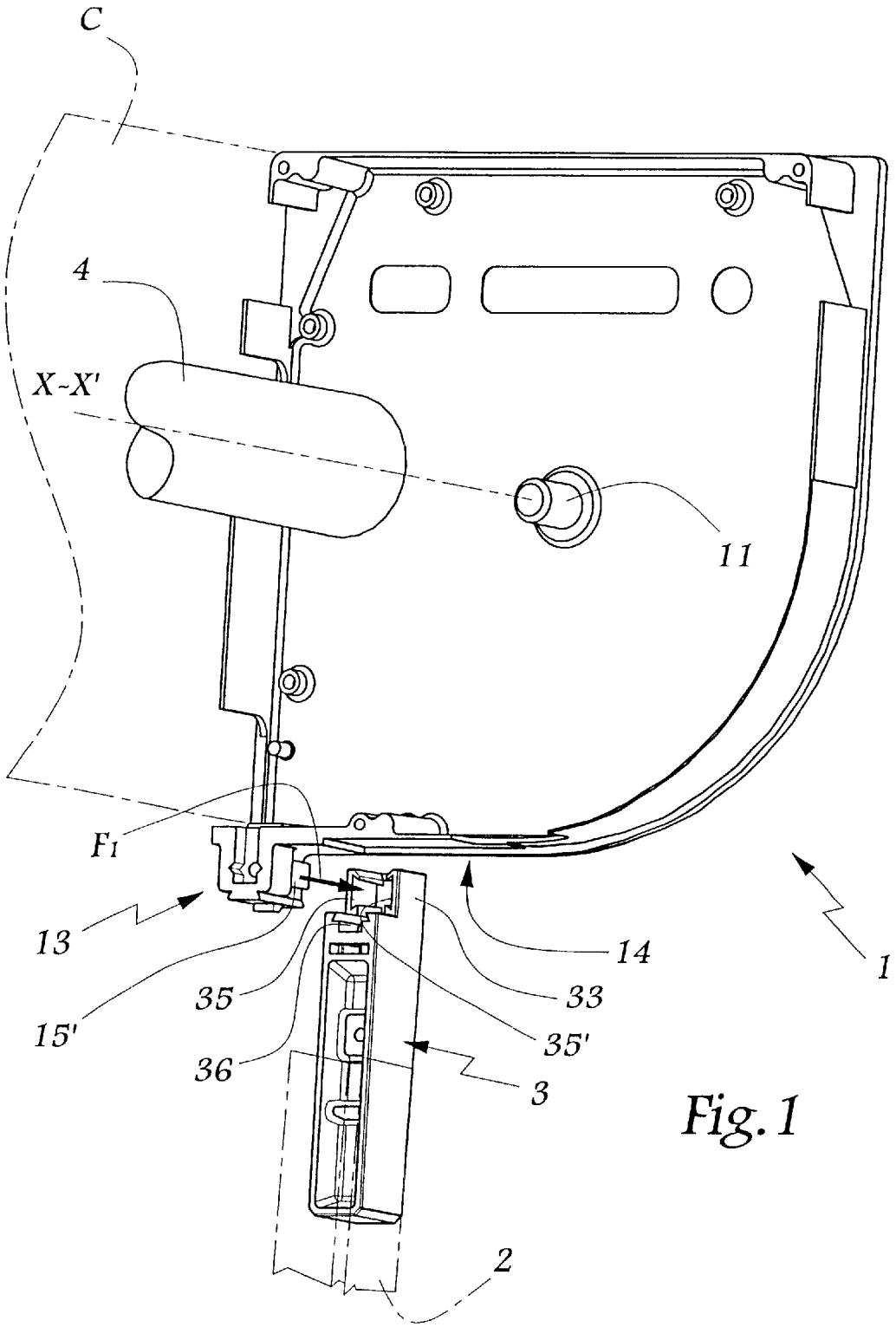
FIG. 1 schematically shows a step of assembly of a mechanism for maneuvering a roller blind according to the invention.

Referring now to the drawings, a roller blind box C is shown partially in dashed and dotted lines in FIG. 1 by its bottom board. An end bracket 1 of the box C is provided to be connected with a slideway 2 by means of a tab 3 partially engaged in the upper part of this slideway 2. The bracket 1 is equipped with a central projection 11 allowing it to support, directly or indirectly, a roller shaft 4 provided to rotate about a substantially horizontal axis X–X'.

In its lower part, the bracket 1 is provided with a projection 13 extending downwardly from the lower edge 14 of the principal part of the bracket 1 and forming elements in relief for hooking the tab 3. These elements in relief comprise two male dovetails 15 and 15' disposed symmetrically on either side of a median plane $P_1$ of the projection 13. These elements in relief also comprsie a lower male dovetail 16 extending over the whole length of the projection 13 while the male dovetails 15 and 15' are limited by a stop 17.

Figure 2:
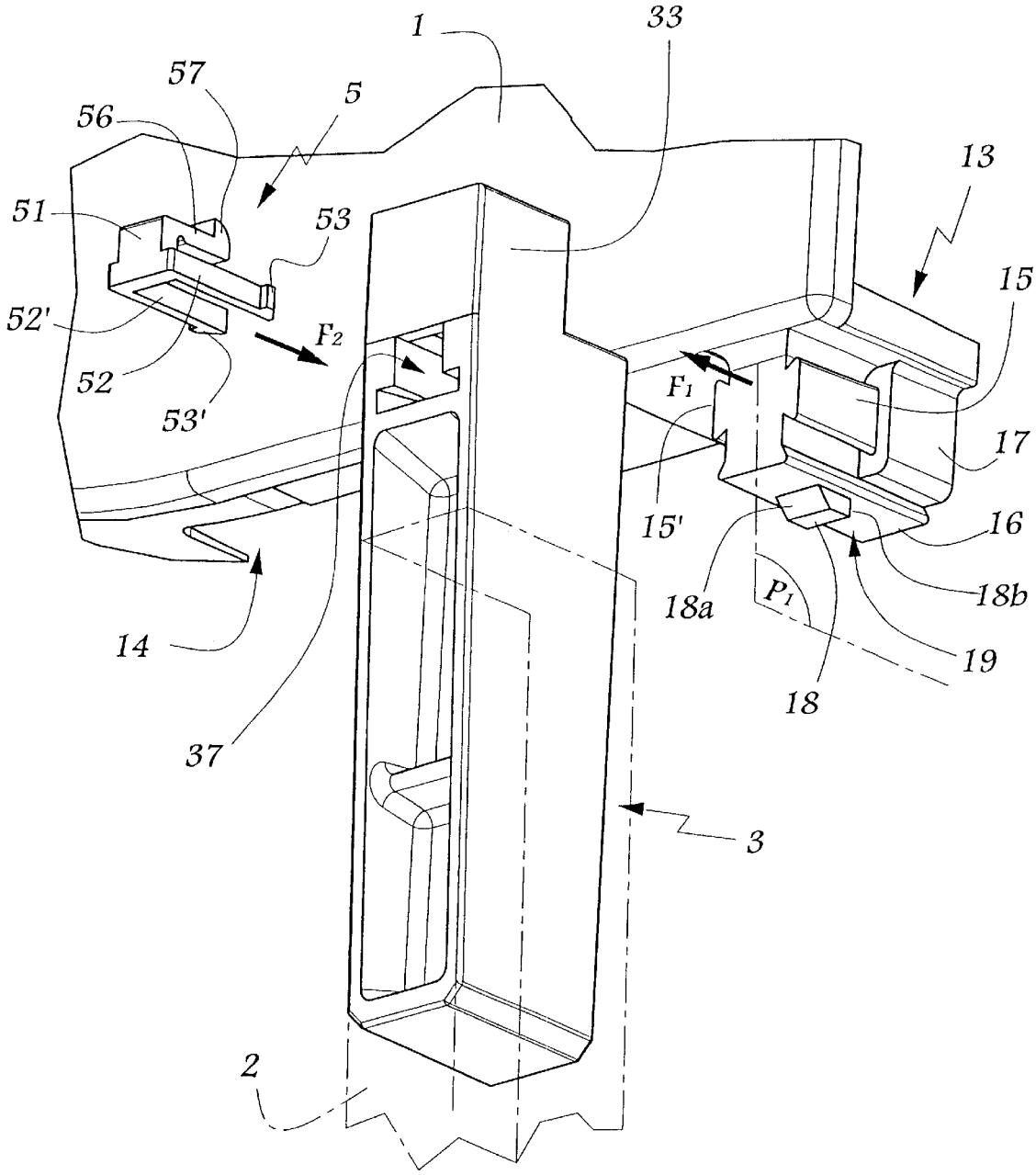
FIG. 2 is a view in perspective, on a larger scale and from the rear, of the mechanism of FIG. 1 in the course of assembly.
Figure 3:
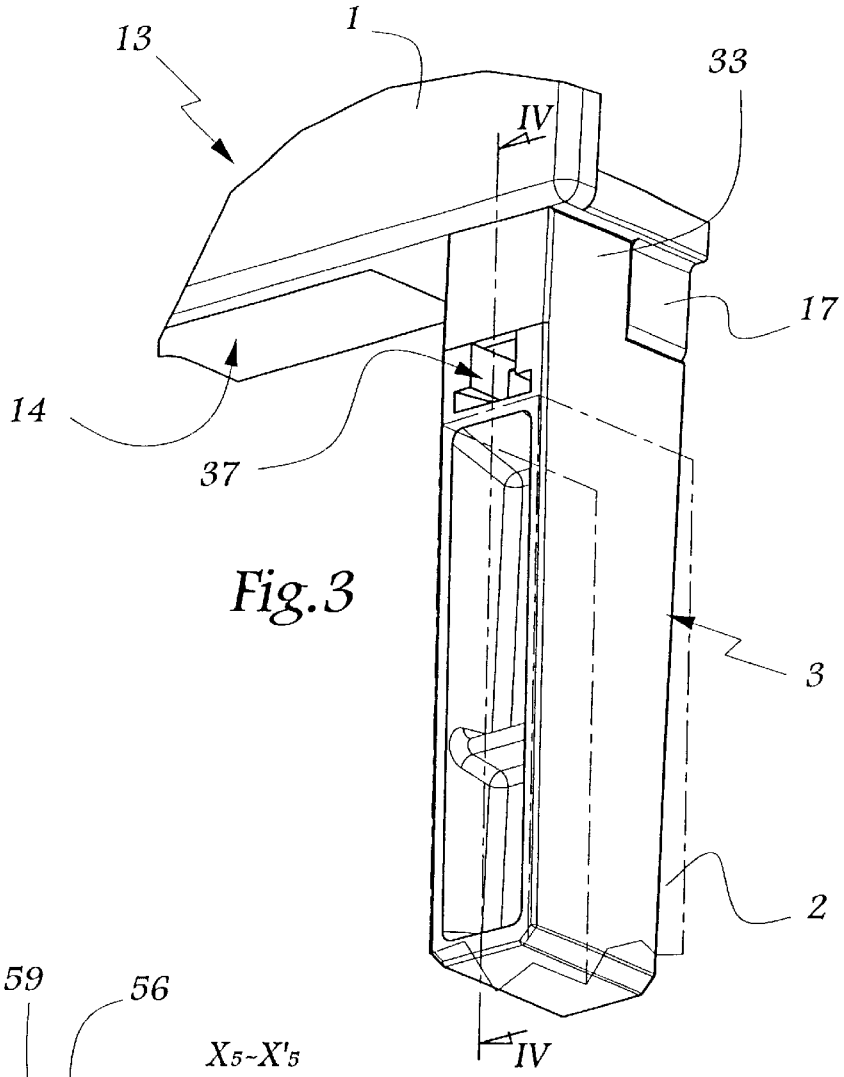
FIG. 3 is a view similar to FIG. 2 while the device is in assembled configuration.
Figure 6:
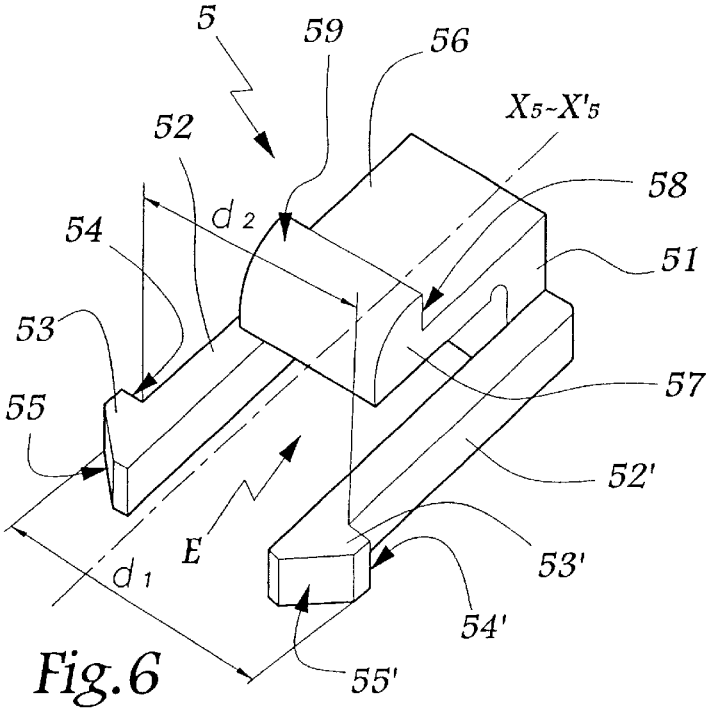
FIG. 6 is a view in perspective on a larger scale of the elastic locking member used in the device of FIGS. 1 to 5.

Recesses 35, 35' and 36 in the form of a female dovetail are respectively provided in the upper part 33 of the tab 3 with a geometry complementary of that of the male dovetails 15, 15' and 16. Elements 15, 15', 16, 35, 35' and 36 allow the projection 13 to hook on the tab 3 by a translation in the direction of arrows $F_1$ in FIGS. 1 and 2, the progress of the bracket 1 in the direction of arrows $F_1$ being limited by the stop 17.

According to the invention, an elastic locking member 5 is provided to immobilize the tab 3 in position engaged on the projection 13. This member is in one piece and moulded from plastics material. It comprises a base part 51 from which extend two tongues 52 and 52' substantially parallel to a central axis $X_5$–$X'_5$ of the member 5 and between which is defined an intermediate space E. At its free end, each tongue 52 or 52' is provided with a beak 53 or 53' facing outwardly with respect to the space E and defined by a surface 54, 54' respectively, substantially perpendicular to axis $X_5$–$X'_5$. Each beak 53, 53' is also bordered by a surface 55, 55' respectively, inclined with respect to axis $X_5$–$X'_5$.

From part 51 there also extends another tongue 56 of generally L-shaped section, with the result that it extends firstly in a direction substantially perpendicular to axis $X_5$–$X'_5$ then in a direction substantially parallel to this axis. At its end, the tongue 56 is provided with a beak 57 defined between a surface 58 perpendicular to axis $X_5$–$X'_5$ and a surface 59 inclined with respect to this axis.

A housing 37 is provided in part 33 of the tab 3 for receiving the member 5. This housing traverses right through the tab 5 and 37*a* denotes its opening on the side of tab 3 opposite the stop 17 when the tab 3 is mounted on the projection 13.

Figure 5:
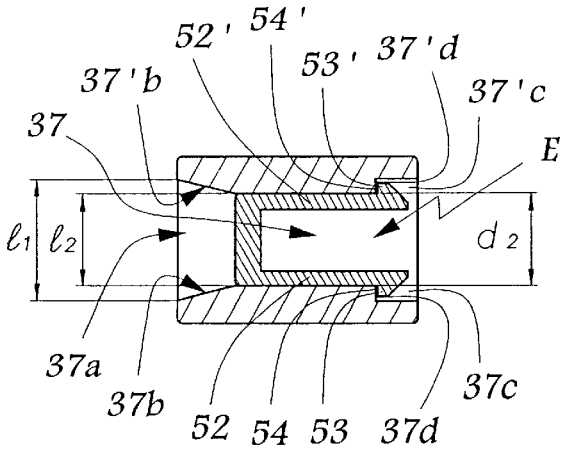
FIG. 5 is a section along line V—V of FIG. 4.

The opening 37*a* comprises an upper part for passage of the tongue 56 and a substantially wider lower part for passage of the tongues 52 and 52'. As is more clearly seen in FIG. 5, the lower part of the opening 37*a* is convergent in the direction of the lower volume of the housing 37. In its entrance zone, the opening 37*a* has a width $1_1$ substantially equal to the distance $d_1$ separating the outer ends of the beaks 53 and 53' of the member 5 at rest. The width of the lower part of the zone 37*a* decreases to a value $l_2$ substantially equal to the distance separating the outer faces of the tongues 52 and 52' in those parts where they do not comprise beaks.

When the member 5 is positioned in the housing 37, the tongues 52 and 52' are deformed in the sense of approach or of narrowing of the space E by the cooperation of the inclined surfaces 55 or 55' with the inclined introduction surfaces 37*b* and 37'*b* of the housing 37. Opposite the opening 37*a*, the housing 37 forms two shoulders 37*c* and 37'*c* for receiving the beaks 53 and 53', the housings 37*c* and 37'*c* each being provided with a surface 37*d* or 37'*d* perpendicular to the direction $F_2$ of introduction of the member 5 into the housing 37.

In this way, when the beaks 53 and 53' are in place in the shoulders 37*c* and 37'*c*, the member 5 is firmly held in position with respect to the tab 3 by cooperation of surfaces 54 and 37*d*, and 54' and 37'*d*, respectively.

Figure 4:
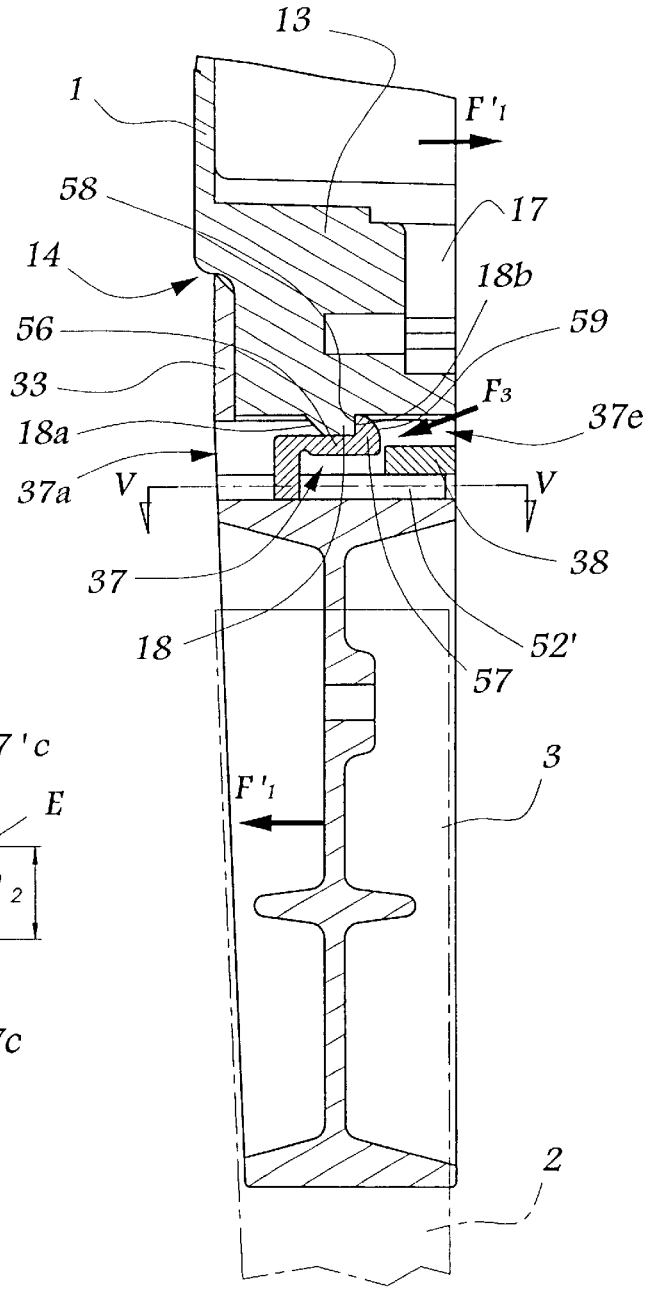
FIG. 4 is a section along line IV—IV of FIG. 3.

A heel 18 projects from the lower surface 19 of the projection 13. This heel comprises a surface 18*a* inclined with respect to the directions of arrows $F_1$ and $F_2$ and a surface 18*b* substantially perpendicular to these directions. The heel 18 is positioned so that, when the tab 3 is engaged on the projection 13 and when the member 5 is introduced into the housing 37, the surface 59 of the beak 57 slides against the surface 18*a* to such a point that the surface 58 of this beak is locked against the surface 18*b* by elastic deformation of the tongue 56, which guarantees a firm immobilization of the member 5 with respect to the projection 13 as shown in FIG. 4.

A rib 38 extends into the housing 37, transversely with respect to the direction of introduction of the member 5. This rib limits the movement of the member 5 in the direction of arrow $F_2$. Moreover, in the case of a beginning of relative movement of the tab 3 and the bracket 1, in the sense of moving apart or of separation of these elements, as represented by arrows $F'_1$ in FIG. 4, the rib 38 abuts against the beak 57 which is itself retained in position by the heel 18. As a result, the movement in the direction of arrows $F'_1$ is blocked by the cooperation of the rib 38 and the member 5.

In this way, the simple introduction of the member 5 into the housing 37 makes it possible to lock this member both with respect to the tab 3 and to the bracket 1 in a direction opposite arrows $F_1$ and $F_2$, which guarantees an efficient connection of the elements 1 and 3 in the direction of arrows $F_1$ and in the direction of arrows $F'_1$.

In practice, the member 5 is positioned in the housing 37 before the projection 13 is introduced in the recesses 35, 35' and 36 of the tab 3, which induces the connection of elements 1 and 3. The assembly thus formed is then engaged in the slideway 2.

Figure 7:
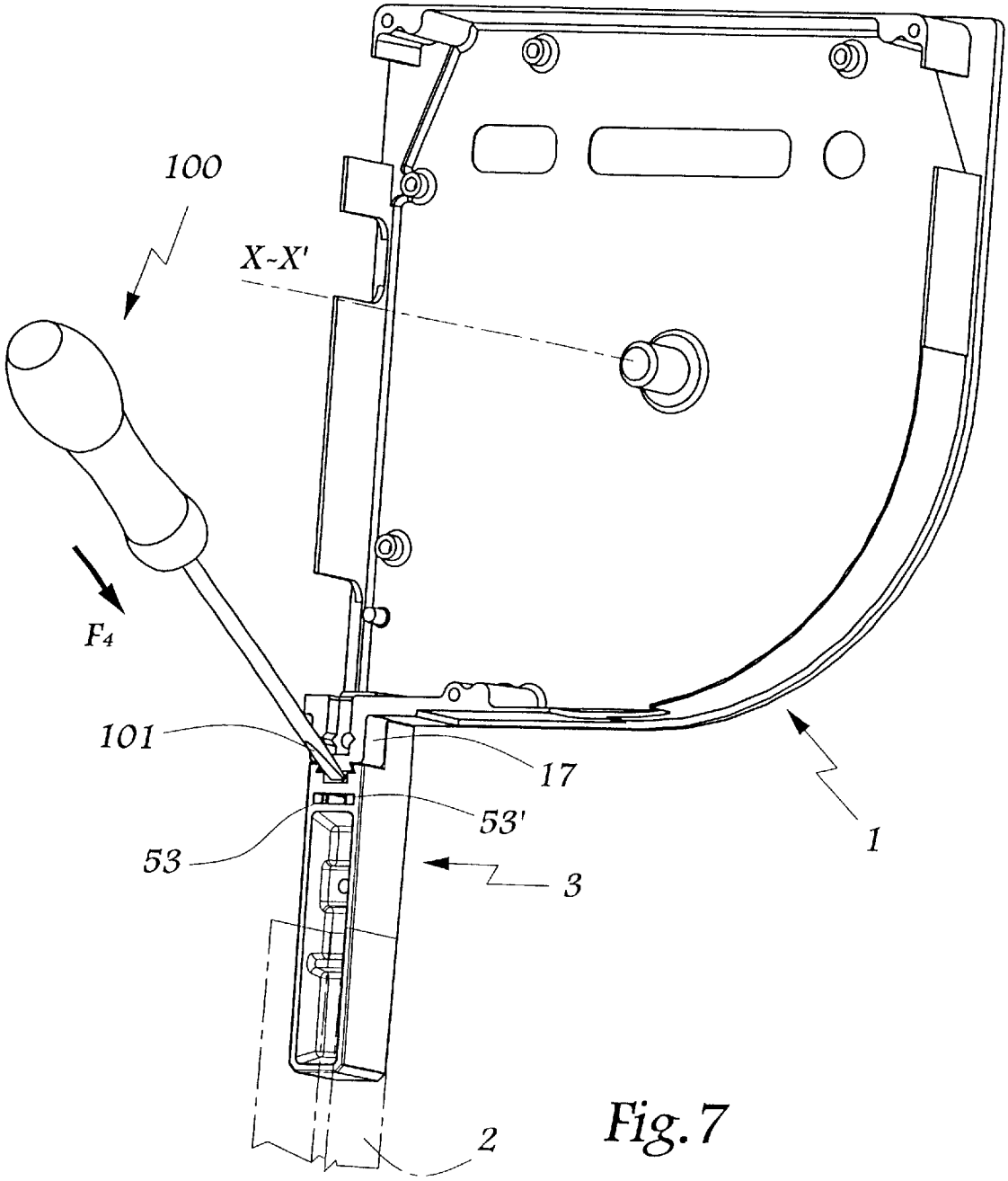
FIG. 7 is a view in perspective in the same direction as FIG. 1 of the mechanism of FIG. 1 in the course of dismantling.

When the assembly thus produced is to be dismantled, the end of the screwdriver 100 can be introduced into the housing 37 through an opening 37*e* provided on the inner side of the tab 3 visible in FIGS. 1 and 7. The housing 37 is accessible by that side, as represented by arrow $F_3$ in FIG. 4, so that the tip 101 of the screwdriver 100 can exert on the beak 57 an effort of thrust $F_4$ making it possible to disengage the beak 57 with respect to the heel 18 and to separate the assembly formed by the tab 3 and the member 5 from the bracket 1 in the direction of arrows $F'_1$.

What is claimed is:

1. A connector for connecting a support for a roller shaft to a slideway for guiding a closure which is selectively wound about the roller shaft, the connector comprising a tab having a lower portion adapted to engage with the slideway and an upper end adapted to engage with the support, an elastic member for locking said tab with the support, said elastic member including at least one elastically yieldable first tongue having a first hook adapted to engage against a surface of said tab and at least one elastically yieldable second tongue having a second hook adapted to engage against a surface of the support, said elastic member forming a stop to prevent displacement of said tab with respect to the support when said tab is connected to the support.

2. The connector of claim 1, wherein said elastic member includes two substantially parallel first tongues each having a hook adapted to engage against spaced surfaces of said tab, and said hooks of said first tongue being oriented opposite one another with respect to an intermediate space defined between said first tongues.

3. The connector of claim 2, wherein said at least one second tongue extends from a base from which said first tongues also extend, and said at least one second tongue being substantially parallel to said first tongues.

4. The connector of claim 1, wherein each hook includes a retaining surface extending substantially perpendicular with respect to a principal direction of the tongue from which the hook extends and by a forward surface forming a ramp which extends transversely with respect to said principal direction.

5. The connector of claim 1, wherein said tab forms a housing for receiving said elastic member, and said housing defining said surface for cooperation with said hook of said at least one first tongue.

6. The connector of claim 5, wherein the support includes a heel projecting from an end surface thereof such that when said tab is in engagement on the support, the heel defines the surface against which said hook of said at least one second tongue is engaged.

7. The connector of claim 5, wherein said housing is provided with an opening for allowing insertion of a means for disengaging one of said hooks with respect to a corresponding surface of the support or of said tab.

8. The connector of claim 5, including a stop within said housing adapted to abut against said elastic member when in said housing.

9. An apparatus for controlling movement of a closure with respect to a roller shaft supported by end supports and wherein the closure is guided vertically by at least one vertically extending slideway, the improvement comprising, a connector for connecting at least one of said supports to the at least one slideway, the connector including a tab having a lower portion engageable with said at least one slideway and an upper portion engageable with the at least one support, an elastic member for locking said tab with respect to said at least one support, the elastic member including at least one elastically yieldable first tongue having a first hook adapted to engage against a surface of said tab and at least one elastically yieldable second tongue having a second hook adapted to engage against a surface of the at least one support, whereby said elastic member forms a lock to prevent displacement of said tab with respect to the at least one support.

10. The apparatus of claim 9 in which said at least one support includes a projection having a plurality of male elements for slidably engaging within a plurality of cooperatively shaped female channels formed in said tab, said projection including a heel portion, an open housing in said tab in which said elastic member is slidingly received such that said hook of said at least one second tongue engages said heel to prevent separation of said tab from said projection and said hook of said at least one first tongue engages the surface of said tab.

* * * * *